US008991295B2

(12) United States Patent
Larue

(10) Patent No.: US 8,991,295 B2
(45) Date of Patent: Mar. 31, 2015

(54) CARTRIDGE GAS ACTUATED FIREARM HAVING BOLT CARRIER/GAS KEY SEAL

(71) Applicant: Mark C. Larue, Leander, TX (US)

(72) Inventor: Mark C. Larue, Leander, TX (US)

( * ) Notice: Subject to any disclaimer, the term of this patent is extended or adjusted under 35 U.S.C. 154(b) by 94 days.

(21) Appl. No.: 13/874,233

(22) Filed: Apr. 30, 2013

(65) Prior Publication Data

US 2014/0318361 A1 Oct. 30, 2014

(51) Int. Cl.
*F41A 5/00* (2006.01)
*F41A 5/24* (2006.01)

(52) U.S. Cl.
CPC ..... *F41A 5/24* (2013.01)
USPC ..... 89/193; 89/191.01; 89/191.02; 42/16

(58) Field of Classification Search
USPC ..... 89/193, 191.01, 191.02; 42/16
See application file for complete search history.

(56) References Cited

U.S. PATENT DOCUMENTS 4,244,273 A * 1/1981 Langendorfer et al. ..... 89/193
4,246,830 A * 1/1981 Krieger ..... 89/179
5,272,956 A * 12/1993 Hudson ..... 89/128
5,351,598 A * 10/1994 Schuetz ..... 89/185
7,316,091 B1 * 1/2008 Desomma ..... 42/16
7,739,939 B2 * 6/2010 Adams ..... 89/191.01
7,784,211 B1 * 8/2010 Desomma ..... 42/16
7,971,518 B2 * 7/2011 Adams ..... 89/191.01
8,166,864 B2 * 5/2012 Herring ..... 89/191.02
8,783,159 B2 * 7/2014 Gomez et al. ..... 89/191.01
8,800,192 B2 * 8/2014 Brown ..... 42/96
2008/0276797 A1 * 11/2008 Leitner-Wise ..... 89/191.01
2014/0190344 A1 * 7/2014 Kenney ..... 89/193

* cited by examiner

*Primary Examiner* — Michelle R Clement
(74) *Attorney, Agent, or Firm* — James L. Jackson

(57) ABSTRACT

A cartridge gas energized firearm mechanism has a receiver assembly having upper and lower receivers. A bolt carrier is moveable within the upper receiver and has a wall structure having a planar gas key seat surface intersected by a gas port. A gas key is mounted to the bolt carrier and has a planar gas key surface in face-to-face seating engagement with the planar gas key seat surface of the bolt carrier, thus establishing a planar surface interface. The gas key has a cartridge gas supply passage in gas communication with the gas port. A tubular seal member is positioned in sealing engagement within seal receptacles of the bolt carrier and gas key and prevents cartridge gas leakage through the planar surface interface.

15 Claims, 3 Drawing Sheets

CARTRIDGE GAS ACTUATED FIREARM HAVING BOLT CARRIER/GAS KEY SEAL

BACKGROUND OF THE INVENTION

1. Field of the Invention

The present invention relates generally to shoulder fired firearms and particularly concerns cartridge gas actuated semi-automatic and full automatic firearms that have a bolt carrier mechanism, with a bolt member located therein for linear movement during firing activity. More particularly, the present invention also concerns a gas key that is mounted to the bolt carrier by retainer screws and defines an internal gas supply passage that is in communication with a gas supply port of the bolt carrier. More specifically, the present invention concerns means for preventing any leakage of cartridge gas at the gas key/bolt carrier planar surface interface.

2. Description of the Prior Art

Virtually all semi-automatic and full automatic tactical rifles, such as the military version AR16, which has semi-automatic and automatic settings and its semi-automatic equivalent, the AR15, have a bolt carrier within the receiver of the firearm. The bolt carrier defines a bolt chamber within which a rear portion of a bolt member is positioned. The bolt member is provided with gas seal rings which establish movable sealing with an internal seal surface of the bolt chamber. The bolt carrier member is linearly moveable within the upper receiver of the firearm mechanism by cartridge gas pressure acting on the gas seal rings of the bolt member when the firearm is discharged and cartridge gas is conducted from the gas port of the barrel of the firearm, through a gas tube and through a gas supply passage of a gas key member and into the bolt chamber. The bolt carrier member defines a wall structure having a gas supply port and defines a generally planar gas key mounting surface that is intersected by the gas supply port.

A gas key, also having a generally planar surface is secured to the planar surface by retainer screws and defines a gas supply passage that is in communication with the gas supply port. When the gas key is properly positioned and seated on the generally planar gas key mounting surface, the planar surfaces of the gas key and bolt carrier member will be tightly secured in face-to-face engagement by the force of the gas key retainer screws. This retained relationship of the gas key member and the bolt carrier member defines a planar surface interface which, in the past has been considered to establish a sealed condition that prevents cartridge gas leakage. However, since the cartridge gas pressure that is conducted from the cartridge gas supply passage of the gas key, through the gas port of the bolt carrier and into the bolt passage of the bolt carrier is quite high, some gas leakage frequently occurs at this planar surface interface.

Any gas pressure leakage at this interface, tends to deplete or decrease the gas pressure that enters the bolt chamber of the bolt carrier and thus decreases the cartridge gas actuating pressure that acts on the seal area of the bolt member and is applied through the bolt member to the bolt carrier member. The cartridge gas pressure is employed to move the bolt carrier member within the upper receiver, against the force of a buffer and buffer spring assembly that is present within the gun stock mechanism. When gas leakage occurs at the planar surface interface, the cartridge gas pressure entering the bolt chamber is diminished or decreased to some extent. This decreased gas pressure can result in insufficient gas actuated movement and force of the bolt member, resulting in ineffective extraction of a cartridge case after a cartridge has been fired and perhaps causing jamming of the cartridge extraction and feeding mechanism of the firearm. Moreover, as usage of this type of firearm continues, the amount of cartridge gas leakage at the gas key/bolt carrier interface can change and cause the cycling operation of the firearm extraction and charging mechanism to change, and thus interfere with proper cycling of the firearm mechanism during use. Therefore, it is desirable to provide an effective seal at the gas key/bolt carrier interface to provide positive assurance that no cartridge gas will leak under any condition of firearm usage.

It is also desirable to provide a sealing mechanism at gas key/bolt carrier interface which will not be adversely affected by excessive heat or cold. This feature is particularly important during sustained use of a semi-automatic or automatic firearm for rapid fire for long periods of time or during use of the firearm when the ambient conditions are extremely cold.

To overcome the gas leakage that typically occurs at the interface of the gas key with the bolt carrier, it is desirable to develop a seal that establishes a bridge at the planar surface interface, establishes positive sealing with the gas key member and with the bolt carrier member and prevents cartridge gas from leaking between the engaged facing planar surfaces.

SUMMARY OF THE INVENTION

It is a primary feature of the present invention to provide a novel semi-automatic or automatic firearm mechanism that is designed for cartridge gas actuation and has a bolt carrier to which is fastened a gas key;

It is another feature of the present invention to provide a novel firearm mechanism having opposed seal recesses in the bolt carrier and gas key, within which is located an annular seal member that bridges the planar surface interface of the gas key member with the bolt carrier; and It is also a feature of the present invention to provide a novel cartridge gas energized firearm mechanism having a generally cylindrical metal seal ring member, with opposed ends thereof press-fitted within opposed seal pockets of the bolt carrier and gas key members and which prevents any cartridge gas leakage at the interface of the gas key member with the bolt carrier Briefly, the various objects and features of the present invention are realized by the provision of a cartridge gas energized firearm, such as the M14 or AR15, which achieves loading and extraction cycling responsive to the energy of cartridge gas when a cartridge is fired within the cartridge chamber. Upon cartridge firing, the bullet of a cartridge is propelled through the gun barrel by the energy of expanding gas that results from ignition and burning of the gun powder of the cartridge. After the bullet has traveled past a gas port in the barrel, a portion of the cartridge gas enters the gas port and is conducted rearwardly through a gas tube to the receiver mechanism of the firearm.

The forward end of the gas tube is received within a tubular receptacle of a gas key member, thus causing a portion of the cartridge gas to be conducted from the gas tube into a gas supply passage that is defined within the gas key member. From the gas supply passage, the cartridge gas is conducted across the interface of the gas key member with the bolt carrier member and is conducted through a gas port of the bolt carrier member into a bolt chamber that is defined within the bolt carrier member. The cartridge gas then acts upon the exposed surface area of a bolt member that is movably positioned within the bolt chamber and develops sufficient force on the bolt member to drive it and the bolt carrier member rearwardly against the force of a buffer and buffer spring assembly that is typically contained within the stock assembly of this type of firearm.

To overcome the gas leakage that typically occurs at the interface of the gas key with the bolt carrier, a seal member is received within seal recesses of the bolt carrier member and the gas key member, bridging the planar surface interface, and is placed under sufficient compression during tightening of gas key retainer screws to prevent gas leakage at the bolt carrier and gas key interface. Alternatively, with the opposed ends of tubular seal member positioned within the seal receptacles of the gas key member and the bolt carrier member, a press apparatus or other force applying apparatus can be employed to apply sufficient force to seat the ends of the seal member within the seal recesses and to bring the planar surfaces of the gas key member and the bolt carrier member into face-to-face engagement. After this has been done, the retainer screws will be threaded into the screw holes and tightened to secure the components against movement from their assembled relationship.

According to the preferred embodiment of the present invention, a tubular seal member is received within opposed seal recesses of the bolt carrier and gas key and is placed under sufficient compression during tightening of gas key retainer screws to prevent gas leakage at the bolt carrier and gas key interface.

Typical AR15 and M16 type firearms each define an upper receiver assembly having a chamber therein that contains a bolt carrier member and permits its linear movement against the force of a buffer spring assembly. The bolt carrier member defines an internal bolt chamber within which a bolt member. The bolt member is moveable linearly and rotatably within the bolt chamber by cartridge gas pressure that is transmitted from the gas tube through a gas supply passage of the gas key member and through a gas port of the bolt carrier member into the bolt chamber. The bolt member has a bolt control lug that projects into a bolt control opening of the bolt carrier and defines bolt control surfaces that impart an increment of rotation to the bolt member as it is moved linearly by cartridge gas pressure after firing or by buffer spring force during bolt return.

The bolt carrier member typically defines a planar surface that is intersected by the gas port. The gas key member defines a planar surface that is disposed in face-to-face relation with the planar surface of the bolt carrier and is secured by retainer screw members. The gas supply passage is in communication with the gas port when the gas key is properly positioned on the bolt carrier. A circular seal recess is defined in the bolt carrier and about the gas port, and a corresponding circular seal recess is defined in the gas key member, about the gas supply passage. A tubular seal member, having a generally cylindrical external configuration is positioned with its end portions located within the circular seal recesses of the bolt carrier and gas key. When the retainer screws or other fasteners are tightened, the end portions of the tubular seal member establish a tight sealing capability with both the bolt carrier and gas key. The tubular seal member establishes an effective sealed bridge at the planar surface interface between the bolt carrier and gas key and prevents any gas leakage from occurring when the firearm is discharged.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments without departing from the spirit and scope of the present invention.

In the Drawings:

FIG. 1 is a side elevation view showing a tactical rifle type firearm that is constructed according to the principles of the present invention and represents the preferred embodiment and best mode of the invention;

FIG. 2 is a partial section view showing the upper and lower receiver assemblies of the firearm of FIG. 1 and further showing the bolt carrier, bolt assembly and gas key mechanism in relation to the cartridge case of a cartridge in seated position with the bolt member;

FIG. 3 is an exploded illustration showing the bolt carrier and bolt assemblies of a tactical firearm representing the prior art;

FIG. 4 is a top view showing the bolt carrier member of the present invention; and FIG. 5 is a section view showing the bolt carrier of FIG. 4 and further showing a bolt carrier/gas key interface seal member that is captured within opposed seal recesses of the gas key member and the bolt carrier member;

DETAILED DESCRIPTION OF PREFERRED EMBODIMENT

Figure 1:
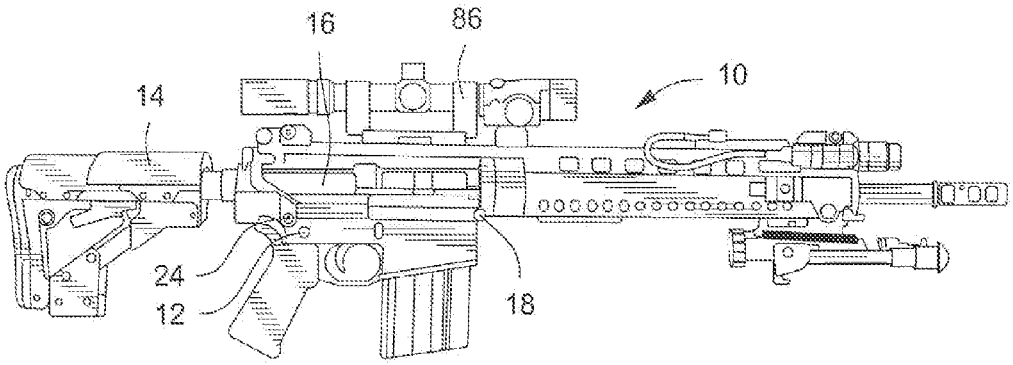
FIG. 1 (PRIOR ART)
Figure 2:
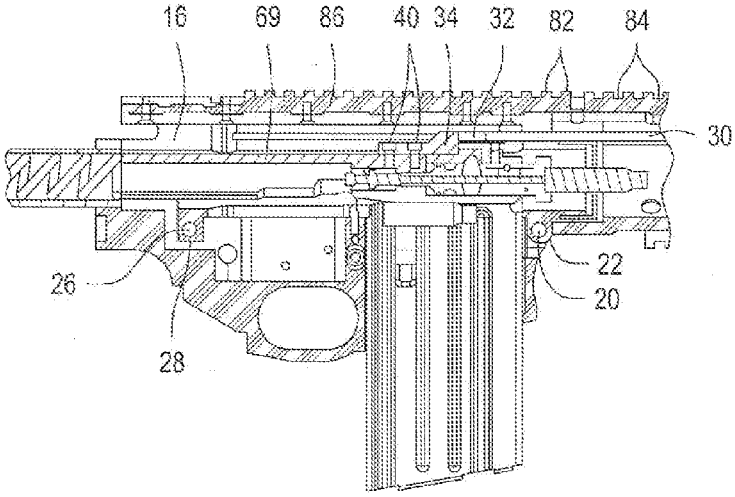
FIG. 2 (PRIOR ART)

Referring now to the drawings and first to FIGS. 1 and 2, a tactical rifle type firearm, embodying the principles of the present invention, is shown generally at 10 and incorporates a lower receiver assembly 12 having a butt-stock assembly 14. The firearm 10 also incorporates an upper receiver assembly 16 that is pivotally connected with the lower receiver 12 by a pivot pin 18 that extends through a pivot opening 20 of a pivot projection 22 that extends downwardly from a forward portion of the upper receiver assembly 16. The upper and lower receiver assemblies are further secured in assembly by a locking pin 24 that extends through the frame portion of the lower receiver assembly and extends through a locking aperture 26 that is defined by a locking projection 28 that extends downwardly from the rear portion of the upper receiver assembly 16.

It should be borne in mind that the upper and lower receiver assemblies can be simply and easily separated by removing the pivot pin 18 and the locking pin 24, both of which are accessible externally of the lower receiver member 12. Disassembly of the upper and lower receiver assemblies is often done, both in servicing facilities and in the field, for the purpose of cleaning and servicing this type of tactical firearm.

Referring now particularly to the section view of FIG. 2, a gas tube member 30 extends rearwardly from a gas block that is mounted to the gun barrel of the firearm and receives cartridge gas via a gas port in the barrel. The forward end portion of the gas tube 30 is received within a tubular gas tube receptacle 32 that is defined by a tubular member 34 projecting forwardly from a gas key member 36. The forward end of the gas tube 30 is typically provided with a small, generally cylindrical seal section 31 that establishes sealing engagement with the inner surface of the tubular gas tube receptacle 32. The gas tube member 30 is capable of being inserted into and withdrawn from the gas tube receptacle, thereby permitting simple and efficient disassembly of the barrel assembly of the firearm from the upper receiver assembly. The gas key member 36 is secured in assembly with a bolt carrier member 38 that is located for guided linear movement within a bolt carrier chamber that is defined by the upper receiver assembly 16 of the firearm.

A pair of retainer screws 40 extend through screw openings of the gas key member 36 and are received by threaded screw holes 42 that are provided in the bolt carrier member 38, thus securing the gas key member 36 in substantially fixed assembly with the bolt carrier member. The gas key member 34 defines a gas supply passage 44 that is in communication with the gas tube receptacle 32 and is also in communication with a gas port 46 that is defined in the wall structure 48 of the bolt carrier member. The gas port 46 serves to conduct cartridge gas into a bolt chamber 50, within which a rearward portion of a bolt member 52 is received.

Figure 3:
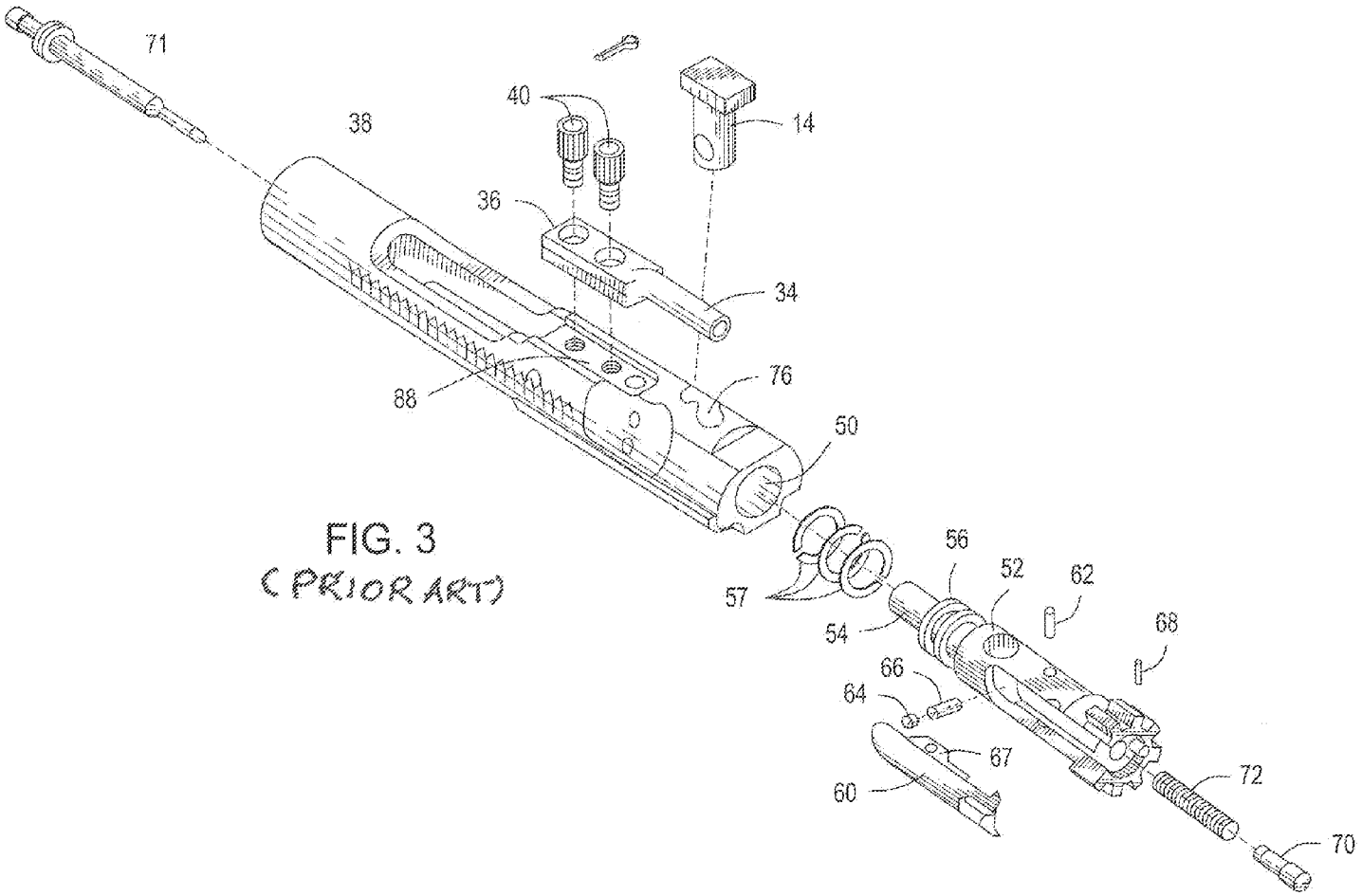
FIG. 3 (PRIOR ART)
Figure 4:
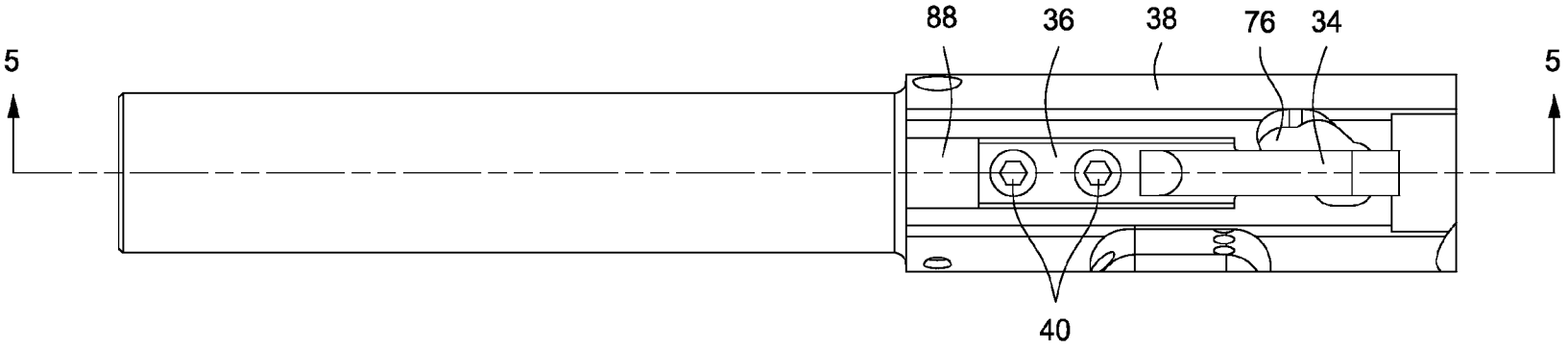
Figure 5:
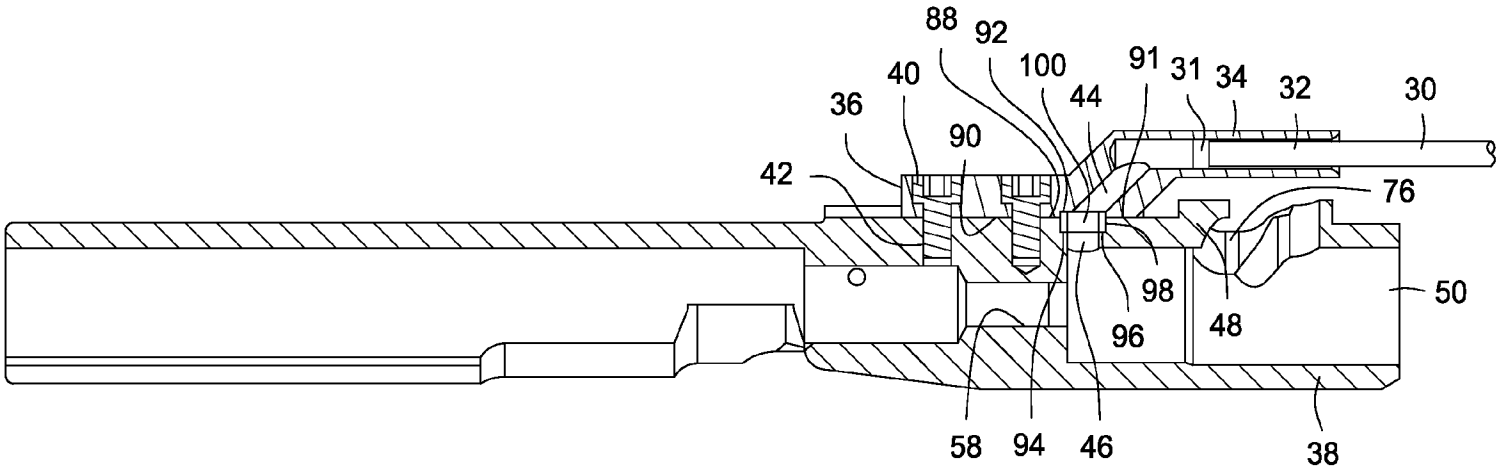

The relation of conventional bolt carrier members and bolt members are best understood with reference to the exploded illustration of FIG. 3, which represents the "prior art". The views of FIGS. 4 and 5 show sealing of the interface of the gas key member 36 with respect to the bolt carrier member 38 and represent the preferred embodiment of the present invention. According to FIG. 3, the bolt member 52 has a rearward projection 54 having a seal carrier section 56 that provides support for a plurality of gas ring members 56 that affect a dynamic seal with an internal sealing surface 58 of the bolt carrier member. An extractor member 60 is pivotally mounted to the bolt member by an extractor pin 62 and is urged in one pivotal direction about the extractor pin by means of an extractor spring 64 that is positioned by an extractor spring insert 66. A cartridge base engaging member 67 of the ejector member engages within the circular groove of a cartridge case so that rearward movement of the bolt carrier member causes extraction of a spent cartridge case from the cartridge chamber of the barrel of the firearm.

Positioning of the extractor member is also controlled by an extractor roll pin 68. An ejector member 70 is movably secured to the bolt member, with its movement being controlled by an ejector spring 72. During extraction of a spent cartridge case, the ejector member comes into contact with receiver structure which causes ejection of the spent cartridge case through the ejection port of the upper receiver of the firearm. A cam pin 74 extends through a cam pin opening 76 of the bolt carrier member 38 and engages within a position control recess 78 of the bolt member 52. The cam pin ensures rotation of the bolt member to its locked position so that the initial presence of high pressure cartridge gas acting through the cartridge case on the bolt member will be resisted by the bolt locking mechanism until such time that cartridge gas has positioned the bolt member for unlocking.

Typically, the upper portion of the upper receiver member 16 defines an upwardly facing accessory mounting rail 80 having equally spaced transverse lands 82 and slots or grooves 84 that extend substantially entirely along the length of the upper receiver member. The accessory mounting rail 80 may be of Picatinny or Weaver design, if desired, or it may take the form of an M24 type mounting rail, such is typically mounted to or formed integrally with U.S. Military sniper rifles. The accessory mounting rail 80 is provided for mounting various types of sighting devices, such as the optical sighting device 86 that is shown in FIG. 1, and/or other accessory devices to a firearm mechanism as desired for enhancement of the various types of shooting activity that is intended.

As explained briefly above, the bolt member 38 defines a generally planar gas key seating surface 88 that is intersected by the gas port 46 that is defined in the wall structure 48 of the bolt carrier member. The bolt carrier member 36 also defines a planar surface 90 that is intersected by the gas supply passage 44. When the gas key member is positioned on the bolt carrier member and is secured in position by tightening of the retainer screws 40, the gas supply passage 44 of the gas key member is in communication with the gas port 46 of the bolt carrier member. The planar surfaces 88 and 90 are secured in face-to-face relation, so that a planar surface interface 91 is defined between the bolt carrier member 38 and the gas key member 36. Since the cartridge gas pressure being communicated from the gas tube 30 of the firearm into the bolt chamber 50 of the bolt carrier member is quite high, the planar surfaces can be forced slightly apart by the cartridge gas pressure condition and possibly also by tensile yielding of the retainer screws, thus permitting cartridge gas pressure leakage at the planar surface interface. This gas leakage condition is objectionable, since the cycling activity of the cartridge extraction, ejection and charging can be adversely affected, causing ineffective cycling and potential jamming of the firearm mechanism by improperly handled cartridges and cartridge cases.

According to the present invention a seal is developed at the seal interface to eliminate any possibility of cartridge gas leakage between the bolt carrier member and the gas key member. Moreover, the cartridge gas seal is effectively maintained during a wide variety of firing conditions, including sustained rapid firing conditions that causes the firearm mechanism to become quite hot and other conditions where the firearm is operated during very cold conditions. According to the preferred embodiment of this invention, as shown particularly in the section view FIG. 5, the gas key member 36 is machined or otherwise formed to define a seal receptacle 92 about the juncture of the gas supply passage with the lower, generally planar surface 90. Similarly, a seal receptacle 94 is machined or otherwise formed within the bolt carrier member about the juncture of the gas port 46 with the generally planar surface 88 of the bolt carrier. A seal member 96 is positioned with portions thereof located within both of the seal receptacles 92 and 94, thus bridging the planar surface interface 91 and establishing seals with the surfaces of both of the seal receptacles 92 and 94. Thus, leakage of cartridge gas pressure at the planar surface is effectively prevented.

Though the seal receptacles 92 and 94 may be of any desired configuration, according to the preferred embodiment of the present invention, the seal recesses are of circular configuration. The seal member 96 is preferably of tubular configuration, having an exterior surface 98 of generally cylindrical configuration and defining a flow port 100 through which cartridge gas pressure is communicated. The seal member 96 may be composed of any desirable material, however, the seal member is preferably composed of a metal, preferably a hardened metal, such as heat treated steel. The external dimension of the seal member 96, with respect to the internal dimensions of the seal receptacles 92 and 94, such that the end portions of the seal member are essentially press-fitted within the seal receptacles as the retainer screws 40 are tightened to secure the gas key within the gas key seat of the bolt carrier member 38. The metal seal composition will ensure that gas leakage does not occur even when the bolt carrier and gas key are subjected to a wide temperature range, such as the elevated heat of sustained rapid fire conditions of firearm use and use of the firearm during very cold conditions. Even without press-fitting of the seal ends within the seal receptacles, the size of the seal can be controlled such that tightening of the retainer screws will cause the end portions of the seal member to establish very tight sealing engagement with the gas key and the bolt carrier within the seal receptacles. The seal member thus establishes a sealed bridge across the planar surface interface of the surfaces 88 and 90 and establishes effective and positive sealing with both the gas key member and the bolt carrier member.

Assembly and Operation

A circular planar interface seal member is positioned with one end thereof located within a seal receptacle 92 or 94 of the gas key member 36 or the bolt carrier member 38. The gas key member 36 is then positioned so that the screw holes of the gas key and the bolt carrier member are aligned, and the gas seal member is positioned so that its end portions are each received within one of the seal receptacles 92 and 94. The retainer screws 40 are then inserted within the screw holes and are tightened by means of an Allen wrench, Torx wrench or the like until it is determined that the planar surfaces 90 and 91 are in face-to-face engagement. Tightening of the retainer screws will cause the respective end portions of the seal member to establish positive sealing with the seal receptacle surfaces. At this point the installation process will be complete.

In the alternative, after positioning a tubular surface interface seal member within one of the seal receptacles, the gas key member is positioned such that the opposite end portion of the seal member is received within the opposite seal receptacle. At this point, a press may be employed or force may be applied by any suitable tool to force the planar surfaces of the gas key member and the bolt carrier into face-to-face seated relation. When this is done, the surface interface seal member will have established effective sealing with both the gas key member and the bolt carrier member, either by press-fitting, by seal deformation or friction retention. After this has been done, the retainer screws will simply be threaded into the screw holes and tightened. In this case, the retainer screws are not employed to force the gas key member into seated assembly with the bolt carrier member. Rather, the retainer screws are employed simply to retain the components in the positions that have been established by means of a press or other force applying apparatus.

If the gas key member 36 is subsequently separated from the bolt carrier member 38, the components may then be re-assembled as desired. However, it is considered preferable to replace the planar interface gas seal member at the time of re-assembly.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A cartridge gas energized firearm mechanism, comprising:

a receiver assembly having upper and lower receivers;

a bolt carrier member being moveable within said upper receiver and defining a wall structure having a substantially planar gas key seat surface being intersected by a gas port;

a bolt member having a portion thereof located within said bolt carrier member;

a gas key member having a substantially planar gas key surface disposed in face-to-face seating engagement with said substantially planar gas key seat surface and defining a planar surface interface, said gas key member defining a cartridge gas supply passage having gas communication with said gas port;

a seal member having sealing engagement with said bolt carrier member and having sealing engagement with said gas key member and preventing cartridge gas leakage through said planar surface interface, said seal member defining a flow port through which cartridge gas is communicated from said cartridge gas supply passage to said bolt carrier member; and a retainer member securing said gas key member to said bolt carrier.

2. The cartridge gas energized firearm mechanism of claim 1, comprising:

a first seal receptacle being defined by said bolt carrier member;

a second seal receptacle being defined by said gas key member; and said seal member being positioned with a part thereof establishing sealing within said first seal receptacle and with a part thereof establishing sealing within said second seal receptacle, said flow port extending through said seal member and having continuous communication with said cartridge gas supply and said cartridge gas supply passage to said bolt carrier member.

3. The cartridge gas energized firearm mechanism of claim 1, comprising:

a first seal receptacle being defined by said bolt carrier member and encompassing said gas port at said substantially planar gas key seat surface;

a second seal receptacle being defined by said gas key member and encompassing said gas supply passage at said substantially planar gas key surface; and said seal member being of tubular form defining said flow port and being positioned with a part thereof establishing sealing within said first seal receptacle and with a part thereof establishing sealing within said second seal receptacle.

4. The cartridge gas energized firearm mechanism of claim 1, comprising:

a first seal receptacle being defined by said bolt carrier member and having a circular wall surface circumscribing said gas port at said substantially planar gas key seat surface;

a second seal receptacle being defined by said gas key member and having a circular wall surface encompassing said gas supply passage at said substantially planar gas key surface; and said seal member being of tubular form defining said flow port and having a generally cylindrical external wall surface being positioned with a part thereof in sealing relation with said circular wall surface of said first seal receptacle and with a part thereof in sealing relation with said circular wall surface of said second seal receptacle.

5. The cartridge gas energized firearm mechanism of claim 4, comprising:

said first and second seal receptacles each having a defined depth; and said seal member being composed of metal and having a length in comparison with said defined depths of said first and second seal receptacles such that positioning said generally planar surfaces of said bolt carrier member and said gas key member in face-to-face relation places said seal member in compression and develops sealing of said seal member within each of said first and second seal receptacles.

6. The cartridge gas energized firearm mechanism of claim 5, comprising:

said seal member being press-fitted within each of said first and second seal receptacles.

7. The cartridge gas energized firearm mechanism of claim 5, comprising:

said retainer member being retainer screws extending through said gas key member and being received by threaded screw openings of said bolt carrier member; and said seal member having opposed sealing portions being forced into said first and second seal receptacles by tightening of said retainer screws and by forcing said substantially planar surfaces of the gas key member and said bolt carrier member into face-to-face engagement.

8. A cartridge gas energized firearm mechanism, comprising:

a receiver assembly having upper and lower receivers, said upper receiver defining a bolt carrier chamber having bolt carrier guide surfaces;

a bolt carrier member being moveable within said bolt carrier chamber and defining a key seat wall structure having a substantially planar gas key seat surface, said bolt carrier member defining a bolt chamber therein;

a gas port being defined in said key seat wall structure;

a first seal recess being defined in said key seat wall structure and being located about said gas port;

a gas key member having a substantially planar gas key surface disposed in face-to-face seating engagement with said substantially planar gas key seat surface of said bolt carrier member and defining a substantially planar surface interface therewith, said gas key member defining a cartridge gas supply passage having gas communication with said gas port and having intersecting relation with said substantially planar gas key surface thereof;

a second seal recess being defined by said gas key member and being located about said intersection of said gas supply passage with said substantially planar gas key surface;

an annular seal member having opposed portions having sealing engagement within said first and second seal recesses and bridging said substantially planar surface interface, said annular seal member preventing leakage of cartridge gas within said substantially planar surface interface, said annular seal member defining a flow port communicating said gas supply passage with said bolt carrier member;

a bolt member having a portion thereof located within said bolt chamber and having a gas seal ring establishing a movable gas seal within said bolt carrier member; and a retainer member securing said gas key member to said bolt carrier and maintaining said substantially planar surfaces in face-to-face engagement.

9. The cartridge gas energized firearm mechanism of claim 8, comprising:

said annular seal member being of tubular form and defining opposed end portions establishing sealing within said first and second seal receptacles.

10. The cartridge gas energized firearm mechanism of claim 8, comprising:

said annular seal member being press-fitted within each of said first and second seal receptacles.

11. The cartridge gas energized firearm mechanism of claim 8, comprising:

said annular seal member being composed of metal and being of tubular form having a substantially cylindrical external surface, said annular seal member defining substantially circular opposed ends being positioned with one of said substantially circular ends establishing sealing within said first seal receptacle and with the other of said substantially circular ends establishing sealing within said second seal receptacle.

12. The cartridge gas energized firearm mechanism of claim 8, comprising:

said first seal receptacle having a circular wall surface circumscribing said gas port at said substantially planar gas key seat surface;

said second seal receptacle having a circular wall surface encompassing said gas supply passage at said substantially planar gas key surface; and said annular seal member being of tubular form having said flow port therein and having a generally cylindrical external wall surface being engaged in sealing relation with said circular wall surfaces of said first and second seal receptacles.

13. The cartridge gas energized firearm mechanism of claim 8, comprising:

said first and second seal receptacles each having a defined depth; and said annular seal member being composed of metal having said flow port therein and having a length in comparison with said defined depths of said first and second seal receptacles such that positioning said generally planar surfaces of said bolt carrier member and said gas key member in face-to-face relation places said seal member in compression and develops sealing of said annular seal member within each of said first and second seal receptacles.

14. The cartridge gas energized firearm mechanism of claim 8, comprising:

said annular seal member being of generally cylindrical tubular form defining said flow port therein, being composed of metal and having opposed generally cylindrical end portions thereof press-fitted within said generally cylindrical internal wall surfaces of said first and second seal receptacles and establishing sealing relation therein.

15. The cartridge gas energized firearm mechanism of claim 8, comprising:

said retainer member being retainer screws extending through said gas key member and engaging threaded openings within said bolt carrier member; and said annular seal member having opposed sealing portions being forced into said first and second seal receptacles by tightening of said retainer screws and by forcing said substantially planar surfaces of the gas key member and said bolt carrier member into face-to-face engagement.

* * * * *